United States Patent [19]

Larsson

[11] 4,052,825

[45] Oct. 11, 1977

[54] METHOD IN THE PRODUCTION OF A WALL ELEMENT AND A WALL TILE FOR USE IN CONNECTION WITH THE METHOD

[75] Inventor: Nils Östen Arnold Larsson, Linkoping, Sweden

[73] Assignee: AB Östgöta-Byggen, Linkoping, Sweden

[21] Appl. No.: 502,490

[22] Filed: Sept. 3, 1974

[30] Foreign Application Priority Data

Sept. 3, 1973 Sweden ..... 7311988

[51] Int. Cl.[2] ..... E04B 1/35; E04C 1/12

[52] U.S. Cl. ..... 52/98; 52/392; 52/429; 52/434; 52/744; 52/747

[58] Field of Search ..... 52/98, 747, 434, 608, 52/435, 429, 744, 612, 743, 390, 392

[56] References Cited

U.S. PATENT DOCUMENTS

| | | | |
|---|---|---|---|
| 670,465 | 3/1901 | Baumbach | 52/390 |
| 1,252,012 | 1/1918 | Meier | 52/98 X |
| 1,809,504 | 6/1931 | Carvel | 52/747 X |
| 2,153,308 | 4/1939 | Miller | 52/98 X |
| 2,841,004 | 7/1958 | Maccaferri | 52/390 |
| 3,395,507 | 8/1968 | Moody | 52/390 |
| 3,515,611 | 6/1970 | Muhlberg et al. | 52/390 X |
| 3,640,041 | 2/1972 | Michieli | 52/390 |
| 3,654,742 | 4/1972 | Wilnau | 52/744 |
| 3,775,916 | 12/1973 | Bair | 52/125 |

FOREIGN PATENT DOCUMENTS

| | | | |
|---|---|---|---|
| 332,194 | 11/1935 | Italy | 52/392 |
| 320,662 | 8/1934 | Italy | 52/98 |
| 59,282 | 4/1938 | Norway | 52/390 |
| 368,290 | 5/1963 | Switzerland | 52/98 |

*Primary Examiner*—Leslie Braum
*Attorney, Agent, or Firm*—Beveridge, DeGrandi, Kline & Lunsford

[57] ABSTRACT

In the production of a wall element being, on its one side, provided with wall-tiles of brick or other suitable wall-facing material, said tiles being rectangular and bedded on the wall element in rows with joint spacing, the method comprising placing the wall element horizontally with the side intended for the tiles facing upwards. This upper side is covered with a layer of mortar for bedding the tiles, after which the tiles are pressed down into the mortar in rows with joint spacing, in such a manner that mortar is forced up laterally of the tiles and fills the joint between the tiles.

A wall-tile of brick or other suitable wall-facing material, which is rectangular and intended to be bedded by means of mortar, together with other such tiles, in rows with joint spacing on a prefabricated wall element, and is substantially U-shaped in cross-section. The front face of the tile defines the outer face of the web, while the outer sides of the legs consist of one pair of the opposing sides of the tile. These sides slope outwardly from the front face of the tile.

10 Claims, 3 Drawing Figures

METHOD IN THE PRODUCTION OF A WALL ELEMENT AND A WALL TILE FOR USE IN CONNECTION WITH THE METHOD

The present invention relates to a method useful in the production of a wall element which, on its one side, is provided with wall-tiles of brick or other suitable wall-facing material, the tiles being rectangular and bedded on the wall element in rows with joint spacing. The method according to the invention is characterised in that the wall element is placed horizontally with the side intended for the tiles facing upwards, that this upper side is covered with a layer of mortar for bedding the tiles and that the tiles are pressed down into the mortar in rows with joint spacing, in such a manner that mortar is forced up laterally of the tiles and fills the joint between the tiles. The joint filler, so important to the finished wall element, thus is provided by the tile bedding operation, and no cleaning of any kind is required. Because, when the tiles are bedded, the joint filler is forced up laterally of the tile from its underface, the upper or front face will not come into contact with the mortar, for which reason this face remains clean after the bedding. Hence, it is not necessary to subject the wall element to any form of treatment once the wall-tiles have been finally pressed down into the mortar.

The invention also relates to a wall-tile of brick or other suitable wall-facing material, which is rectangular and intended to be bedded by means of mortar together with other such tiles in rows with joint spacing on the prefabricated wall element. According to the invention, the tile is substantially U-shaped in cross-section, the front face of the tile defining the outer face of the web, while the outer sides of the legs consist of one pair of the opposing sides of the tile, which slope outwardly from the front face of the tile. By pressing the legs down into a layer of mortar on the wall element which lies horizontally during the bedding operation, the tile will, because of wedge effect, be fixed by the mortar which is forced up laterally of the tile and fills the joint between the tiles, as the legs are pressed down.

The invention will be described in greater detail hereinbelow with reference to the accompanying drawing which shows a wall-tile suitable for carrying out the method and a wall element under production.

Figure 1:
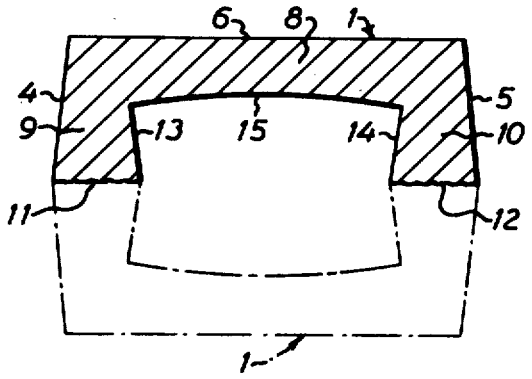
FIG. 1 is a cross-section of the wall-tile.
Figure 2:
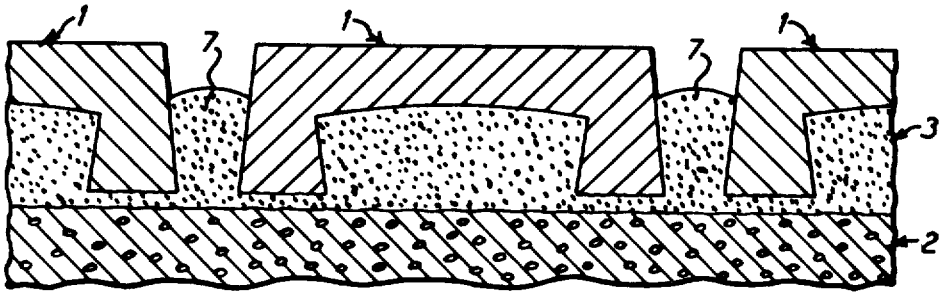
FIG. 2 is also a cross-section of part of the wall element under production.

Referring to the drawings, the rectangular wall-tile 1, preferably of brick, is intended to be bedded together with other similar tiles in rows, with joint spacing, on a prefabricated wall element 2 of suitable material. The wall element 2 can consist of concrete, light-weight concrete or wood. It can also be of sandwich construction which, in the finished state, comprises both an inner wall and an outer wall, the latter giving the impression of forming a tiled wall. Such a construction can suitably contain one or more layers of Leca (light expanded clay aggregate).

The tiles 1 are intended to be pressed down in a layer 3 of mortar on the upper side of the wall element 2. The mortar must be plastic while the tiles are bedded, which requires that the wall element 2 be at least substantially horizontal during the bedding operation.

The opposing parallel lateral sides 4 and 5 of the tile 1 slope outwardly from the front face 6 of the tile 1. As the tile 1 is pressed down in the layer 3 of mortar it will therefore, due to wedge effect, be fixed by the mortar which is forced up laterally of the tile 1 and fills the joint 7 between the tiles.

As is apparent from the drawing, the wall-tile 1 has a substantially U-shaped cross-section, the front face 6 of the tile defining the outer face of the web 8 and the two sides 4 and 5 sloping outwardly from the front face 6 defining the outer sides of the legs 9 and 10. Because of this U-shape, the tile 1 will, as it is pressed down into the layer 3, force out relatively little mortar. As a further result, it has been possible to impart to the tile 1 a substantially even body thickness which is substantially equal to half of the distance between the front face 6 and the free ends 11 and 12 of the legs 9 and 10. This is of the utmost importance in the bedding operation, when the tiles are of brick and must be soaked in water before bedding.

The inner sides 13 and 14 of the legs 9 and 10 are defined by faces converging in the direction of the free ends 11 and 12, so that the tile 1, because of the wedge effect, is also fixed in the mortar which fills the space between the legs 9 and 10 as the tile 1 is pressed down.

The risk of air preventing the mortar from totally filling the space between the legs 9 and 10 has been eliminated by arching the inner face 15 of the web 8, with the highest point located substantially midway between the legs 9 and 10. As the tile 1 is pressed down in the plastic mortar, the last amount of air under the tile 1 will thus escape at the highest point of the inner face 15.

It is also of importance for the fixing of the tile 1 to the wall element 2 that the free ends 11 and 12 of the legs 9 and 10 have fractured surfaces and the plane of these ends should be at least substantially parallel with the front face 6 of the tile 1. This is most simply achieved by producing the tile 1 by extrusion together with a reversed tile, as illustrated in FIG. 1 with dash-dot lines. The tiles are then broken apart at fractional indications at the ends 11 and 12 of the legs, the fractured surfaces thus being formed.

Figure 3:
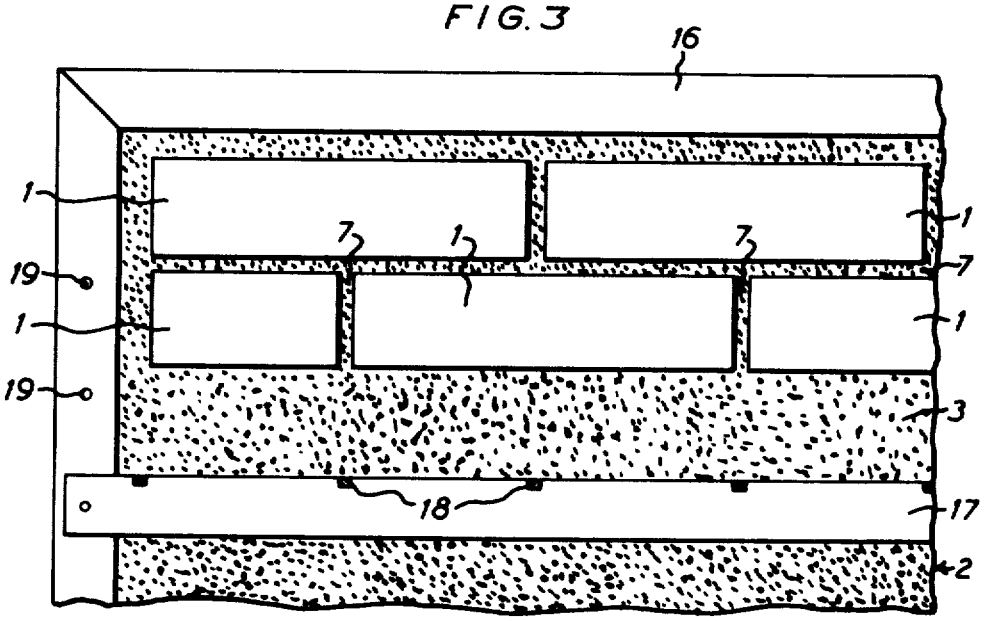
FIG. 3 is a top plan view, on another scale, of a corner portion of the wall element under production.

The wall element 2 which, in FIG. 3, is provided with wall tiles 1, consists of a sandwich unit produced in a frame 16 surrounding the element. A layer 3 of mortar is spread out on the element 2, the tiles 1 being fixed to the element by the mortar. The thickness of the layer 3 is determined by the height of the frame 16 above the element 2, and the simplest manner of levelling out the layer 3 is with a rule or similar screeding device cooperating with the upper edge of the frame 16. The tiles 1 then press down the mortar which is in the plastic state, the tiles 1 being spaced from each other such that they give the impression of forming a tiled wall. When the tiles 1 are pressed down they should register with the edge of a rule 17 which is provided with markings 18 corresponding to the positions of the joints. When a row is finished the rule 17 is moved the distance of one row which is equal to the width of the tile 1 plus the width of a longitudinal joint 7, the rule 17 being then fixed in its new position. For the purposes of this fixing, the rule 17 is provided with pegs or the like which fit into holes 19 located in both sides of the frame 16 and spaced apart from each other a distance corresponding to the width of a row.

According to one embodiment of the invention the brick tile is 250 mm long, 65 mm wide and 25 mm high.

The width of the legs 9 and 10 and the thickness of the web 8 are approximately equal to half of the height of the tile, i.e. 10–15 mm. The angle of slope of the sides 4 and 5 is only a few degrees, for example, 3°–5°. The angle of slope of the inner sides 13 and 14 is of the same size range. The rise of the arched inner face is 2–3 mm.

The sides 4, 5, 13 and 14 do not necessarily need to be plane, but may, for example, be slightly arched. The surfaces of these sides should be uneven, since this aids the grip of the mortar.

The layer 3 of mortar should be of such a thickness that the ends 11 and 12 of the legs do not come into contact with the underlying wall element 2 when the tiles 1 are pressed down. With the tiles 1 in pressed-down position, the mortar should be 2–3 mm thick between the wall element 2 and the ends 11 and 12 of the legs. When bedding tiles of the above-mentioned size, the layer 3 of mortar should therefore, at the commencement of the operation be approximately 18 mm thick.

I claim:

1. A wall-tile of brick or other suitable wall-facing material, which is rectangular and intended to be bedded by means of mortar, together with other such tiles, in rows with joint spacing on a prefabricated wall element, wherein the tile is substantially U-shaped in cross-section having a web and legs, the front face of the tile defining the outer face of the web, while the outer sides of the legs consist of one pair of the opposing sides of the tile which slope outwardly from the front face of the tile.

2. A wall-tile as claimed in claim 1, wherein the inner sides of the legs are defined by faces sloping towards each other in the direction of the free ends of the legs.

3. A wall-tile as claimed in claim 1, wherein the inner face of the web is arched, with its highest point located substantially midway between the legs.

4. A wall-tile as claimed in claim 3, wherein the free ends of the legs have fractured surfaces the planes of which are at least substantially parallel with the front face of the tile.

5. A wall-tile as claimed in claim 1, wherein the thickness of the tile is essentially even and substantially equal to half of the distance between the front face and the free ends of the legs.

6. A wall-tile as claimed in claim 5 wherein the inner face of the web is arched, with its highest point located substantially midway between the legs.

7. In the production of a wall element being, on its one side, provided with wall-tiles of brick or other suitable wall-facing material, said tiles being rectangular and bedded on the wall element in rows with joint spacing, the method comprising placing the wall element horizontally with the side intended for the tiles facing upwards; covering the upper side with a layer of mortar for bedding the tiles; and pressing into the mortar laterally-spaced tiles having sides with surfaces which protrude laterally toward corresponding protruding surface on tiles adjacent thereto, said pressing step forcing the mortar up between the tiles to overlie the protruding surfaces and to contact only a portion of the sidewalls of the tiles to form a recessed joint between the tiles.

8. A method as claimed in claim 1, characterized in that the mortar, in which the tiles are pressed down, is in the plastic state.

9. A method as claimed in claim 1, characterized in that the layer of mortar on the upper side of the wall element is of such a thickness that the tiles, when pressed down into the mortar, will be spaced from the underlaying wall element.

10. A method as claimed in claim 1, characterized in that the wall element is provided with a frame surrounding said element and extending, with its upper edge, above the upper side of the wall element; and that the frame is filled with the mortar intended for the bedding of the tiles.

* * * * *